US011376708B2

(12) United States Patent
Ono et al.

(10) Patent No.: US 11,376,708 B2
(45) Date of Patent: Jul. 5, 2022

(54) POLISHING APPARATUS

(71) Applicant: Kioxia Corporation, Tokyo (JP)

(72) Inventors: Syunichi Ono, Kuwana Mie (JP); Tsutomu Miki, Yokkaichi Mie (JP)

(73) Assignee: KIOXIA CORPORATION, Tokyo (JP)

( * ) Notice: Subject to any disclaimer, the term of this patent is extended or adjusted under 35 U.S.C. 154(b) by 683 days.

(21) Appl. No.: 16/285,194

(22) Filed: Feb. 25, 2019

(65) Prior Publication Data

US 2020/0078903 A1 Mar. 12, 2020

(30) Foreign Application Priority Data

Sep. 12, 2018 (JP) ..... JP2018-170679

(51) Int. Cl.
*B24B 49/00* (2012.01)
*B24B 37/005* (2012.01)

(52) U.S. Cl.
CPC ..... *B24B 49/003* (2013.01); *B24B 37/005* (2013.01)

(58) Field of Classification Search
CPC ..... B24B 37/27; B24B 37/30; B24B 49/003; B24B 49/08; B24B 49/10; B24B 49/16; B24B 37/013; B24B 37/005
USPC ..... 451/259, 283, 285, 287, 288
See application file for complete search history.

(56) References Cited

U.S. PATENT DOCUMENTS 6,325,696 B1 12/2001 Boggs et al.
2003/0087586 A1* 5/2003 Kaushal ..... B24B 49/10 451/8
2014/0329439 A1* 11/2014 Chew ..... B24B 37/0053 451/5

FOREIGN PATENT DOCUMENTS

JP H09-150367 A 6/1997
JP H09-260316 A 10/1997
JP 2009-038232 A 2/2009
JP 2011-083856 A 4/2011

* cited by examiner

*Primary Examiner* — Orlando E Aviles
*Assistant Examiner* — Thomas Raymond Rodgers
(74) *Attorney, Agent, or Firm* — Foley & Lardner LLP

(57) ABSTRACT

A polishing apparatus includes a polisher that polishes a target object to be polished. A holder is rotatable while holding the target object to be polished. Multiple concentric elastic members around the center of a rotation shaft of the holder are provided on the holder and elastically press the target object to be polished against the polisher. Multiple sensors are provided in the elastic members and detect vibration from a polishing surface of the target object to be polished. The detected vibration allows the polishing apparatus to create an unevenness map of the polishing surface and correspondingly actuate the concentric elastic members to remove the unevenness, according to a control sequence set in advance, based on the detected vibration, in a polishing control program to control the concentric elastic members.

18 Claims, 10 Drawing Sheets

1

POLISHING APPARATUS

CROSS-REFERENCE TO RELATED APPLICATION

This application is based upon and claims the benefit of priority from Japanese Patent Application No. 2018-170679, filed on Sep. 12, 2018, the entire contents of which are incorporated herein by reference.

FIELD

Embodiments described herein relate generally to a polishing apparatus.

BACKGROUND

When a semiconductor wafer or a material film on the semiconductor wafer is polished with an almost constant pressure using a polishing apparatus, such as adopting a chemical mechanical polishing (CMP) method or the like, flatness or evenness of the semiconductor wafer and/or thickness of the material film sometimes is irregular.

Examples of related art include JP-A-2011-083865, JP-A-09-260316, and JP-A-2001-127925 (U.S. Pat. No. 6,325,696).

DETAILED DESCRIPTION

Figure 1:
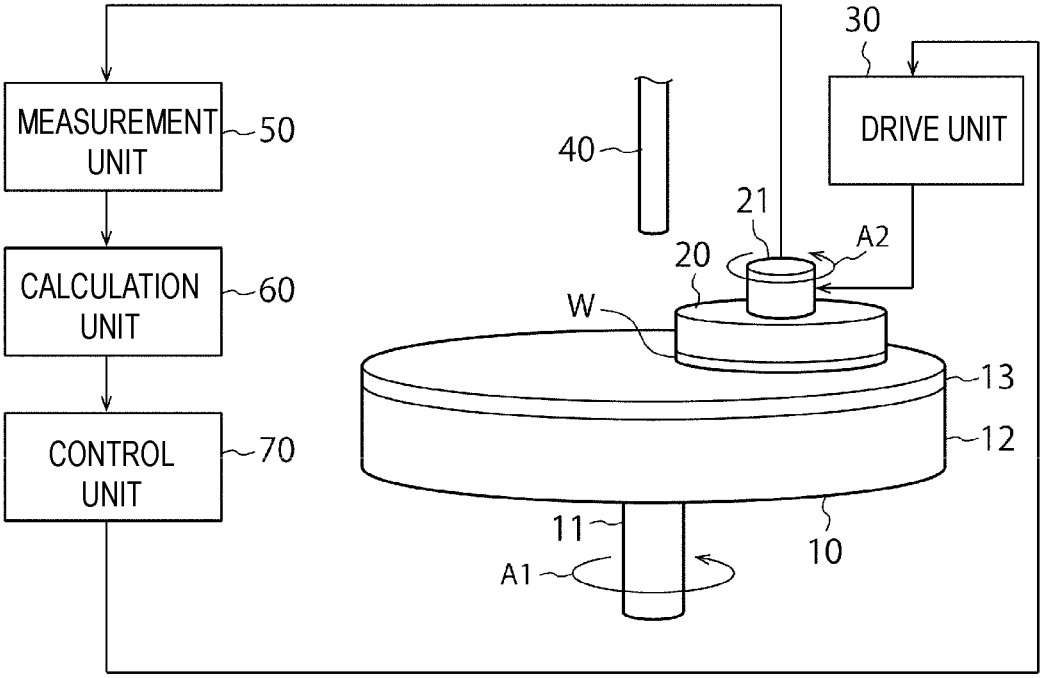
FIG. 1 is a schematic view illustrating a configuration example of a polishing apparatus according to a first embodiment.

Embodiments herein provide a polishing apparatus operable to polish and thus achieve or increase the flatness and evenness of a semiconductor wafer or a material film after polishing, thereby reducing or removing irregularity in the thicknesses of the semiconductor wafer and the material film.

In general, according to one embodiment, a polishing apparatus includes a polishing unit configured to polish a target object to be polished. A holder is rotatable while holding the target object to be polished. Multiple elastic members are provided on the holder concentrically around a center of a rotation shaft of the holder and elastically press the target object to be polished against the polishing unit. Multiple vibration sensors are provided in the elastic members and detect vibration from a polishing surface of the target object to be polished.

Hereinafter, embodiments of the present disclosure will be described with reference to the drawings. The present embodiments do not limit the present disclosure. The drawings are schematic or conceptual, and the ratios between portions and the like are not necessarily the same as the actual values thereof. In the specification and the drawings, the same elements, which have been previously described with reference to the previous drawings, are marked with the same reference numerals, and a detailed description thereof will be appropriately omitted.

First Embodiment

FIG. 1 is a schematic view illustrating a configuration example of a polishing apparatus 1 according to a first embodiment. The polishing apparatus 1 is, for example, a chemical mechanical polishing (CMP) apparatus that polishes a semiconductor wafer W that is the target object to be polished. In addition, the present embodiment is not limited to the CMP apparatus and may be applied to a polishing apparatus that polishes any material to be flat.

The polishing apparatus 1 includes a polishing unit 10 (polisher), a holder 20, a drive unit 30 (driver), a slurry supply unit 40 (slurry supplier), a measurement unit 50 (detector), a calculation unit 60 (calculator), and a control unit 70 (controller). The polishing unit 10 includes a turntable 12 configured to be rotatable (turn about itself) about a shaft 11 in a direction of the arrow A1, and a polishing pad 13 provided on the turntable 12.

The holder 20 holds the semiconductor wafer W and is configured to be rotatable (turn about itself) about a shaft 21 in a direction of the arrow A2 together with the semiconductor wafer W. In addition, as described below with reference to FIGS. and 3, the holder 20 has film-shaped elastic members (hereinafter, referred to as membranes) and presses the semiconductor wafer W against the polishing unit 10 by introducing air into the membranes. The pressure, which presses the semiconductor wafer W against the polishing unit 10, may be controlled by a gas pressure in the membrane.

The drive unit 30 controls the rotation of the holder 20 and/or the gas pressure in the membrane. The gas pressure in the membrane may be controlled by using a non-illustrated air pump or the like.

The slurry supply unit 40 supplies slurry, as a polishing liquid, onto the polishing pad 13. The slurry includes abrasive grains and is introduced between the semiconductor wafer W and the polishing pad 13 to facilitate the polishing of the semiconductor wafer W.

Here, a configuration of the holder 20 will be described.

Figure 2:
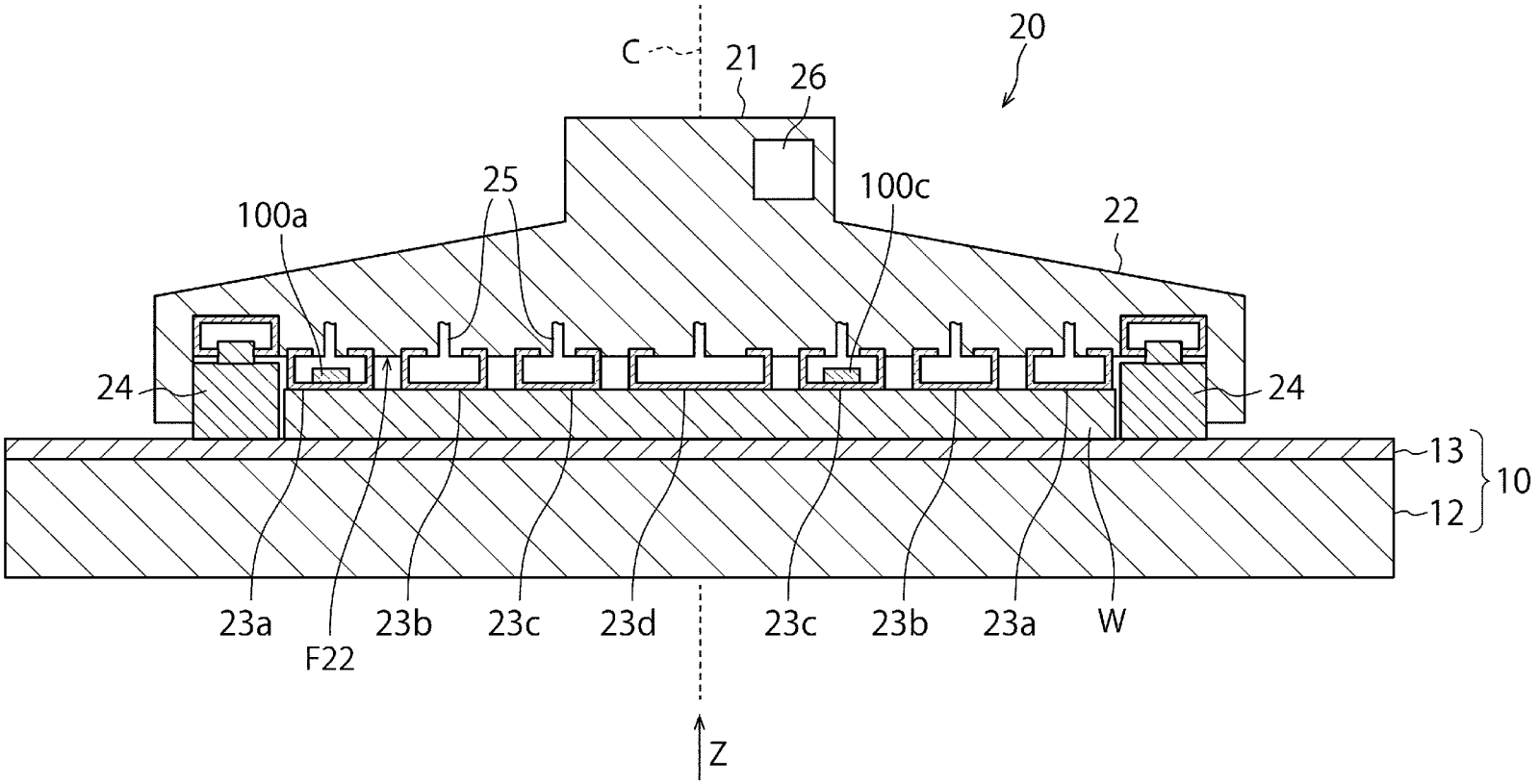
FIG. 2 is a cross-sectional view illustrating an example of a configuration of a holder.

FIG. 2 is a cross-sectional view illustrating an example of a configuration of the holder 20. The holder 20 has a head unit 22, a plurality of membranes 23*a*, 23*b*, 23*c*, and 23*d*, and a retainer ring 24. The head unit 22 is connected to the rotation shaft 21 and has a surface F22 that faces the polishing pad 13. The plurality of membranes 23*a*, 23*b*, 23*c*, and 23*d* are provided on the surface F22 of the head unit 22. Each of the membranes 23*a*, 23*b*, 23*c*, and 23*d* is, for example, a member formed by rolling, in a tubular shape (cylindrical shape), a film made of an elastic material such as resin or rubber, and the membranes 23*a*, 23*b*, 23*c*, and 23*d* are configured such that the tubular members are arranged in a ring shape around a center C. In addition, the membrane 23*d* may be a disc-shaped member having the center C as a center thereof.

Each of the membranes 23*a*, 23*b*, 23*c*, and 23*d* has a hollow cavity H and expands as gas is supplied into the cavity H. In addition, each of the membranes 23*a*, 23*b*, 23*c*, and 23*d* is contracted when the supply of the gas into the cavity H is stopped or the gas in the cavity H is drawn out, so that the gas in the cavity H is discharged. In this way, the pressure which presses the semiconductor wafer W against the polishing pad 13 of the polishing unit 10 is controlled by adjusting the gas pressure in the cavities H of the membranes 23*a*, 23*b*, 23*c*, and 23*d*. In addition, the gas may be, but is not particularly limited to, for example, air, inert gas, and the like.

The head unit 22 has supply ports 25 capable of supplying the gas into the membranes 23*a*, 23*b*, 23*c*, and 23*d*. The drive unit 30 supplies the gas independently into the membranes 23*a*, 23*b*, 23*c*, and 23*d* through the supply ports 25. That is, the gas pressure in the membranes 23*a*, 23*b*, 23*c*, and 23*d* may be individually adjusted. Therefore, the membranes 23*a*, 23*b*, 23*c*, and 23*d* may press the semiconductor wafer W with different pressures. In addition, a sensor control unit 26, which serves to control operations of vibration sensors to be described below, is provided in the head unit 22.

The retainer ring 24 is provided along an outer edge of the head unit 22 so as to face a lateral side of the semiconductor wafer W. During the polishing, the retainer ring 24 prevents the semiconductor wafer W from protruding from the holder 20 due to the rotation of the polishing unit 10 or the rotation of the holder 20.

Figure 3:
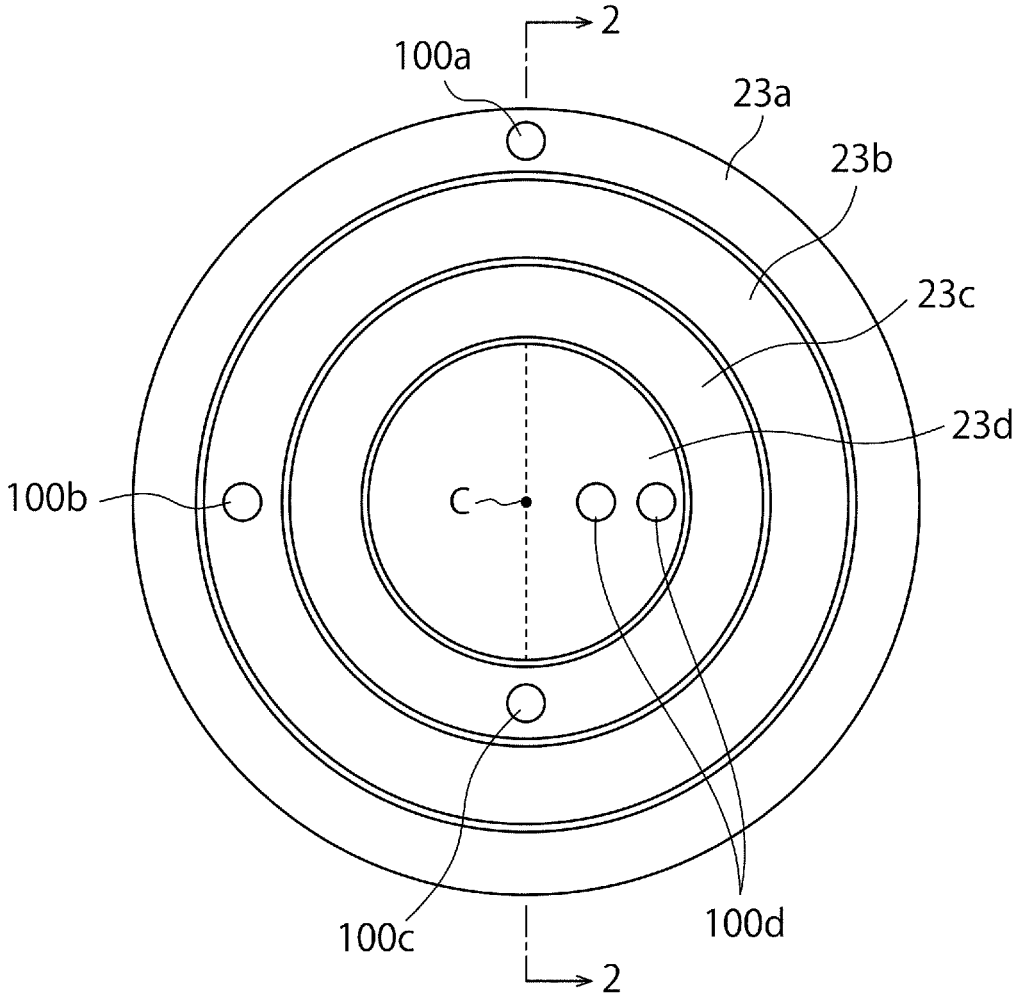
FIG. 3 is a top plan view of a surface of the holder when viewed in a Z direction.

FIG. 3 is a top plan view of the surface F22 of the holder 20 when viewed in a Z direction. In addition, FIG. 2 illustrates a cross section taken along line 2-2 in FIG. 3. In addition, the Z direction is the direction perpendicular to a rotation surface of the holder 20 (direction in which the rotation shaft 21 extends). Each of the membranes 23*a*, 23*b*, 23*c*, and 23*d* is formed concentrically around the center C of the rotation shaft 21 of the holder 20. The disc-shaped membrane 23*d* is provided on the center C, and the membrane 23*c* is disposed outside the membrane 23*d*. The membrane 23*b* is disposed outside the membrane 23*c*. Further, the membrane 23*a* is disposed outside the membrane 23*b*. That is, the membranes 23*d*, 23*c*, 23*b*, and 23*a* are arranged in this order progressively further from the center C. In this way, the membranes 23*a*, 23*b*, 23*c*, and 23*d* are individually provided in concentric circular areas around the center C, and these areas may press, with different pressures, the semiconductor wafer W against the polishing unit 10. In addition, in the present embodiment, the four membranes 23*a*, 23*b*, 23*c*, and 23*d* are provided in the four areas. However, the number of membranes is not limited to four but may be three or less or five or more. Therefore, the number of areas for controlling the pressing of the semiconductor wafer W may be increased or decreased.

As illustrated in FIGS. 2 and 3, vibration sensors 100*a*, 100*b*, 100*c*, and 100*d* are provided in the cavities H of the membranes 23*a*, 23*b*, 23*c*, and 23*d*, respectively. Each of the vibration sensors 100*a*, 100*b*, 100*c*, and 100*d* is a contact vibration sensor; for example, an acoustic emission (AE) sensor.

During the polishing of the semiconductor wafer W, the vibration sensors 100*a*, 100*b*, 100*c*, and 100*d* are positioned on bottom portions of the membranes 23*a*, 23*b*, 23*c*, and 23*d* so as to come into contact with the semiconductor wafer W through the membranes 23*a*, 23*b*, 23*c*, and 23*d*, and detect vibration from the semiconductor wafer W. The vibration may be detected continuously or intermittently in a certain cycle.

The AE sensor uses a piezoelectric element and may detect elastic waves having frequency components (e.g., several kilohertz (KHz) to several megahertz (MHz)) from a low band to a high band that occur on a polishing surface of the semiconductor wafer W (an interface between the semiconductor wafer W and the polishing pad 13).

The intensity of the vibration from the polishing surface of the semiconductor wafer W varies depending on distances between the polishing surface of the semiconductor wafer W and the vibration sensors 100*a*, 100*b*, 100*c*, and 100*d*. For example, when the distances between the polishing surface of the semiconductor wafer W and the vibration sensors 100*a*, 100*b*, 100*c*, and 100*d* are comparatively short (the semiconductor wafer W is comparatively thin), the intensity of the vibration from the polishing surface of the semiconductor wafer W is increased. On the contrary, when the distances between the polishing surface of the semiconductor wafer W and the vibration sensors 100*a*, 100*b*, 100*c*, and 100*d* are comparatively long (the semiconductor wafer W is comparatively thick), the intensity of the vibration from the polishing surface of the semiconductor wafer W is decreased. In this way, the thickness of the semiconductor wafer W may be detected based on the intensity of the vibration from the polishing surface of the semiconductor wafer W. Irregularity in the thickness of the semiconductor wafer W represents unevenness of the polishing surface of the semiconductor wafer W. Therefore, the unevenness (flatness) of the polishing surface of the semiconductor wafer W may be detected by detecting the intensity of the vibration from the polishing surface of the semiconductor wafer W.

Figure 4:
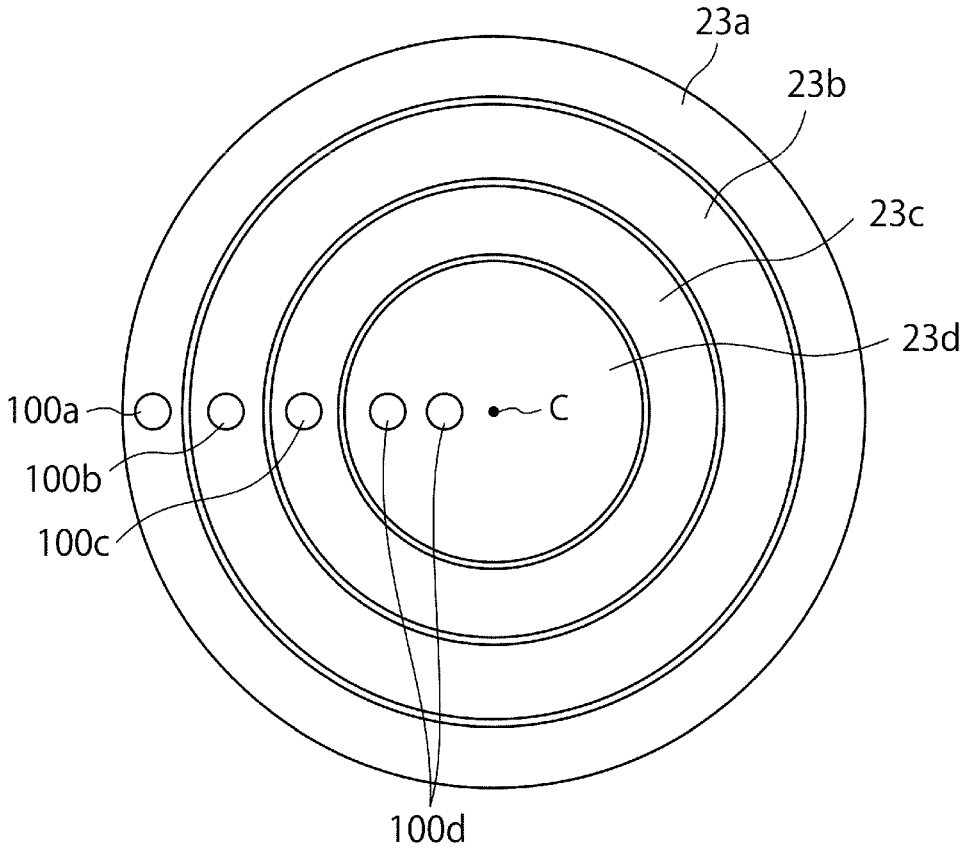
FIG. 4 is a top plan view illustrating another arrangement of vibration sensors.

The vibration sensors 100*a*, 100*b*, 100*c*, and 100*d* are disposed at optional positions in the membranes 23*a*, 23*b*, 23*c*, and 23*d*, respectively. For example, in FIG. 3, the vibration sensor 100*a* is disposed at a certain position in the membrane 23*a*. The vibration sensor 100*b* is disposed, in the membrane 23*b*, at a position which is rotated at approximately 90° with respect to the vibration sensor 100*a*. The vibration sensor 100*c* is disposed, in the membrane 23*c*, at a position which is rotated at approximately 90° with respect to the vibration sensor 100*b* (at approximately 180° with respect to the vibration sensor 100*a*). The vibration sensor 100*d* is disposed, in the membrane 23*d*, at a position which is rotated at approximately 90° with respect to the vibration sensor 100*c* (at approximately 270° with respect to the vibration sensor 100*a*). In addition, in FIG. 3, the membrane 23*d* is comparatively wide, and thus a plurality of vibration sensors 100*d* are provided in the membrane 23*d*. In this way, the positions of the vibration sensors 100*a*, 100*b*, 100*c*, and 100*d* are arbitrarily set on the surface F22 of the head unit 22. For example, FIG. 4 is a top plan view illustrating another arrangement of vibration sensors. As illustrated in FIG. 4, the vibration sensors 100*a*, 100*b*, 100*c*, and 100*d* may be arranged approximately rectilinearly in a radial direction of the surface F22.

During the process of polishing the semiconductor wafer W, the vibration sensors 100*a*, 100*b*, 100*c*, and 100*d* are almost stationary at the positions thereof without rotating together with the rotation of the holder 20. That is, the holder 20 and the membranes 23*a*, 23*b*, 23*c*, and 23*d* rotate about the center C, but the vibration sensors 100*a*, 100*b*, 100*c*, and 100*d* revolve reversely relative to the holder 20 and the membranes 23*a*, 23*b*, 23*c*, and 23*d*. Therefore, the vibration sensors 100*a*, 100*b*, 100*c*, and 100*d* appear to be almost stationary from the viewpoint of a user (the casing of the polishing apparatus 1).

In the present embodiment, a linear motor system is used to reversely rotate the vibration sensors 100*a*, 100*b*, 100*c*, and 100*d* relative to the rotations of the holder 20 and the membranes 23*a*, 23*b*, 23*c*, and 23*d*.

Figure 5A:
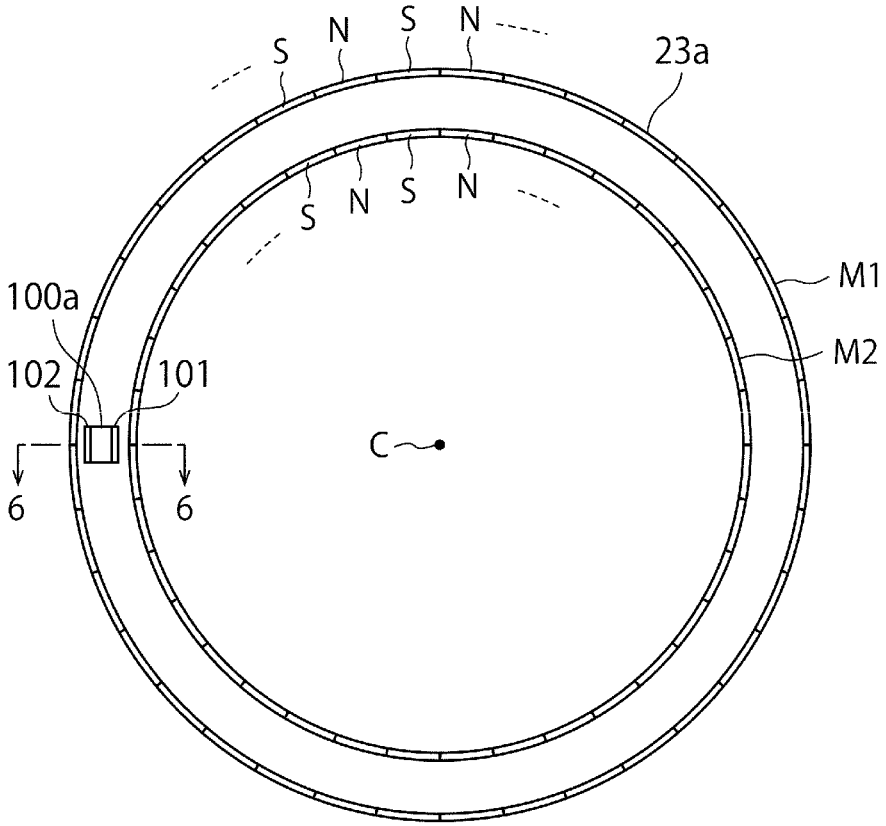
FIG. 5A is a top plan view illustrating a membrane and the vibration sensor.
Figure 5B:
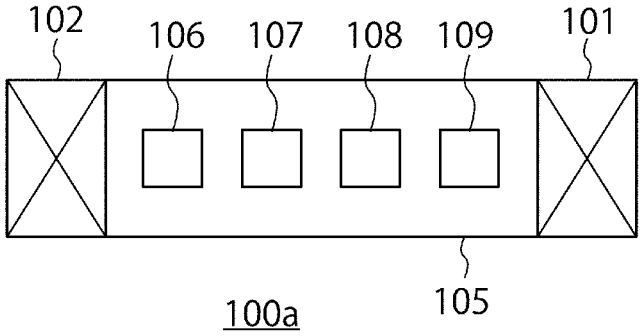
FIG. 5B is a schematic view illustrating a configuration example of the vibration sensor.

FIG. 5A is a top plan view illustrating the membrane 23*a* and the vibration sensor 100*a*. FIG. 5B is a schematic view illustrating a configuration example of the vibration sensor 100*a*. In addition, the other membranes 23*b*, 23*c*, and 23*d* and the other vibration sensors 100*b*, 100*c*, and 100*d* also have the same configuration as the membrane 23*a* and the vibration sensor 100*a*. Therefore, only the configurations of the membrane 23*a* and the vibration sensor 100*a* will be described, and descriptions of the other membranes and the other vibration sensors will be omitted.

A pair of magnet rails M1 and M2 is provided at both sides in the membrane 23*a*. The magnet rails M1 and M2 are configured such that N-pole permanent magnets and S-pole permanent magnets are alternately arranged.

The vibration sensor 100*a* has electromagnets 101 and 102 disposed at both ends of a main body 105. When the membrane 23*a* rotates together with the head unit 22, the electromagnets 101 and 102 are controlled to alternate the N polarity and the S polarity. Therefore, the vibration sensor 100*a* receives a propulsive force along the magnet rails M1 and M2, so that the vibration sensor 100*a* moves relative to the membrane 23*a*. When the vibration sensor 100 is rotated in a direction opposite to the direction of the arrow A2 at a speed approximately equal to a speed of the holder 20, the vibration sensor 100 appears to be almost stationary when viewed from the main body of the polishing apparatus 1, by the user, or from the ground surface. In this way, the vibration sensor 100*a* is moved relative to the membrane 23*a* by using the linear motor system. Therefore, the vibration sensor 100*a* appears to be almost stationary when viewed by the user. The vibration sensors 100*b*, 100*c*, and 100*d* are also moved relative to the membranes 23*b*, 23*c*, and 23*d* by using the linear motor system.

The main body 105 of the vibration sensor 100*a* has a communication unit 106 which may communicate with the sensor control unit 26 of the head unit 22, an electromagnet control unit 107 which controls the electromagnets 101 and 102 based on a control signal from the sensor control unit 26, and a sensor unit 108 which is disposed on a lower surface of the main body 105, and a battery 109 which supplies electric power to the respective constituent elements. In addition, the battery 109 may be omitted and electric power may be supplied to the vibration sensor 100*a* from the head unit 22 by using a wireless power transfer technology.

Each of the vibration sensors 100*a*, 100*b*, 100*c*, and 100*d* is a contact sensor such as an AE sensor. Therefore, the vibration sensors 100*a*, 100*b*, 100*c*, and 100*d* need to be in contact with the bottom portions of the membranes 23*a*, 23*b*, 23*c*, and 23*d* so as to be in indirect contact with the semiconductor wafer W through the membranes 23*a*, 23*b*, 23*c*, and 23*d*.

Figure 6A:
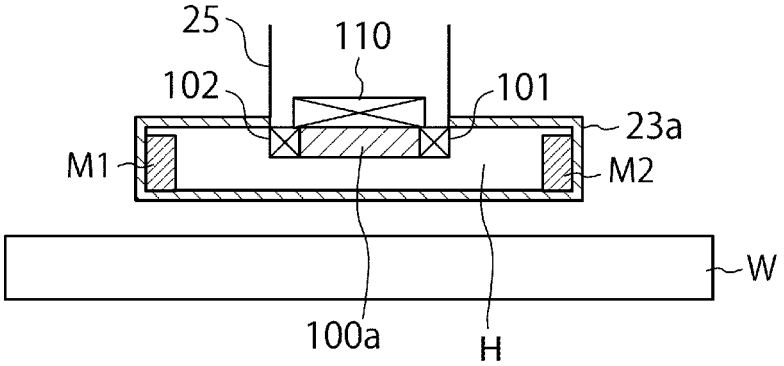
FIGS. 6A and 6B are cross-sectional views taken along line 6-6 in FIG. 5A.
Figure 6B:
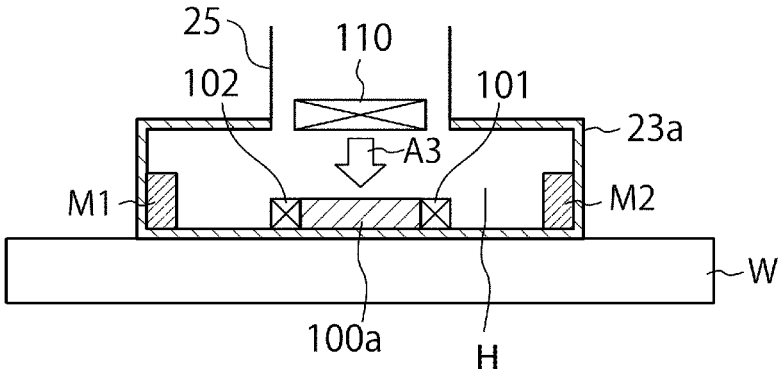

For example, FIGS. 6A and 6B are cross-sectional views taken along line 6-6 in FIG. 5A. FIG. 6A illustrates a state where the vibration sensor 100*a* is on standby before or after polishing. FIG. 6B illustrates a state where the vibration sensor 100*a* detects vibration during the polishing. In the present embodiment, an electromagnet 110 is provided at a part of the supply port 25 and may attract the vibration sensor 100*a* with magnetic force.

During the standby illustrated in FIG. 6A, the electromagnet 110 functions upon being supplied with power. The vibration sensor 100*a* includes, for example, a magnetic material included in an iron core in the electromagnets 101 and 102, and as a result, the vibration sensor 100*a* is attracted by the electromagnet 110. The vibration sensor 100*a* is configured to be fixed to the electromagnet 110 such that the vibration sensor 100*a* is not freely moved in the membrane 23*a*.

Meanwhile, during the polishing illustrated in FIG. 6B, the electromagnet 110 is stationary as it is not supplied with power, and the vibration sensor 100*a* is pressed against the bottom portion of the membrane 23*a* by its own weight and/or blasting force (wind pressure) of the gas from the supply port 25. More specifically, the lower surface (sensor unit 108) of the vibration sensor 100*a* is pressed against an upper surface of the bottom portion of the membrane 23*a*. Further, during the polishing, as described with reference to FIG. 5A, the vibration sensor 100*a* moves relative to the membrane 23*a* by using the linear motor system. Therefore, the vibration sensor 100*a* moves according to the linear motor system in the state where the vibration sensor 100*a* is in contact with the bottom portion of the membrane 23*a*. When the holder 20 rotates and the vibration sensor 100*a* moves in the reverse direction in the membrane 23*a*, it is possible to know the position (height) of the polishing surface in the entire area corresponding to the membrane 23*a*. That is, it is possible to know the thickness in the area of the semiconductor wafer W which corresponds to the membrane 23*a*. In addition, in the membrane 23*a*, the lower surface of the vibration sensor 100*a* and the upper surface of the bottom portion of the membrane 23*a* may be made of a material having a small coefficient of friction. In addition, a lubricant may be supplied between the lower surface of the vibration sensor 100*a* and the upper surface of the bottom portion of the membrane 23*a* in order to reduce friction between the vibration sensor 100*a* and the membrane 23*a*.

Similarly, the vibration sensors 100*b*, 100*c*, and 100*d* also move by the linear motor system in the state where the vibration sensors 100*b*, 100*c*, and 100*d* are in contact with the bottom portions of the membranes 23*b*, 23*c*, and 23*d*. Therefore, it is possible to know positions (heights) of the polishing surface in the entire area which correspond to the membranes 23*b*, 23*c*, and 23*d*, respectively.

The measurement unit 50, the calculation unit 60, and the control unit 70 will be described with reference back to FIG. 1. In some embodiments, the measurement unit 50, the calculation unit 60 and the control unit 70 may be integrated into a dedicated controller or computer.

The measurement unit 50 receives signals which are transmitted from the communication units 106 of the vibration sensors 100*a*, 100*b*, 100*c*, and 100*d*, through the sensor control unit 26 of the head unit 22. For example, voltage values of the signals represent intensity (speed) of vibration at each of the membranes 23*a*, 23*b*, 23*c*, and 23*d*. Therefore, the measurement unit 50 refers to the voltage values of the signals from the vibration sensors 100*a*, 100*b*, 100*c*, and 100*d*, thereby ascertaining the intensity of the vibration in each of the areas of the semiconductor wafer W where the membranes 23*a*, 23*b*, 23*c*, and 23*d* are provided. The measurement unit 50 performs analog-to-digital (AD) conversion on the signals from the vibration sensors 100*a*, 100*b*, 100*c*, and 100*d* and outputs the AD-converted signals to the calculation unit 60. The measurement unit 50 performs AD conversion on signals having a wide frequency range from a low frequency to a high frequency and transmits the digital signals to the calculation unit 60 in real time during the polishing.

The calculation unit 60 determines unevenness (flatness) of the polishing surface of the semiconductor wafer W in accordance with magnitudes of the signals from the vibration sensors 100*a*, 100*b*, 100*c*, and 100*d*. For example, when the signal from the vibration sensor 100*a* is smaller than the signal from the vibration sensor 100*b*, the vibration sensor 100*a* is farther from the polishing surface of the semiconductor wafer W than the vibration sensor 100*b*. Therefore, the thickness of the semiconductor wafer W in the area which corresponds to the membrane 23*a* is greater than the thickness of the semiconductor wafer W in the area which corresponds to the membrane 23*b*. That is, this means that the polishing surface in the area corresponding to the membrane 23*a* protrudes further than the polishing surface in the area corresponding to the membrane 23*b*. On the contrary, when the signal from the vibration sensor 100*a* is larger than the signal from the vibration sensor 100*b*, the vibration sensor 100*a* is closer to the polishing surface of the semiconductor wafer W than the vibration sensor 100*b*. Therefore, the thickness of the semiconductor wafer W in the area which corresponds to the membrane 23*a* is smaller than the thickness of the semiconductor wafer W in the area of the membrane 23*b*. That is, this means that the polishing surface in the area corresponding to the membrane 23*a* is recessed further than the polishing surface in the area corresponding to the membrane 23*b*. In this way, an unevenness state (flatness) of the polishing surface of the semiconductor wafer W in the areas corresponding to the membranes 23*a*, 23*b*, 23*c*, and 23*d* is ascertained. Therefore, the calculation unit 60 may create an unevenness map for the corresponding polishing surface.

The calculation unit 60 may calculate a magnitude of the unevenness of the semiconductor wafer W based on a magnitude of a difference between the signal from the vibration sensor 100*a* and the signal from the vibration sensor 100*b*. Alternatively, the calculation unit 60 may calculate the thickness of the semiconductor wafer W based on the magnitude of the signal.

The control unit 70 controls the gas pressures in the membranes 23*a*, 23*b*, 23*c*, and 23*d* based on the unevenness map for the polishing surface of the semiconductor wafer W. For example, as described above, if the polishing surface in the area corresponding to the membrane 23*a* protrudes further than the polishing surface in the area corresponding to the membrane 23*b*, the control unit 70 makes the gas pressure in the membrane 23*a* higher than a gas pressure in a recipe and/or makes the gas pressure in the membrane 23*b* lower than the gas pressure in the recipe. Therefore, the pressure, which presses the semiconductor wafer W against the polishing unit 10, is increased in the area of the protruding membrane 23*a*. Meanwhile, the pressure, which presses the semiconductor wafer W against the polishing unit 10, may be decreased in the area of the recessed membrane 23*b*. Therefore, it is possible to reduce unevenness (irregularity in the thickness) of the semiconductor wafer W and thus polish and flatten the semiconductor wafer W. Here, the recipe is a control sequence which is set in advance in a polishing control program to control the gas pressures in the membranes 23*a*, 23*b*, 23*c*, and 23*d*.

The control unit 70 controls the drive unit 30 to change the gas pressures in the membranes 23*a*, 23*b*, 23*c*, and 23*d*. The drive unit 30 changes the gas pressures in the membranes 23*a*, 23*b*, 23*c*, and 23*d* by operating a non-illustrated air pump or the like based on a command from the control unit 70. In this way, the control unit 70 may correct the unevenness state (flatness) of the polishing surface of the semiconductor wafer W in real time during the polishing by feedback-controlling the gas pressures in the membranes 23*a*, 23*b*, 23*c*, and 23*d*. As a result, the polishing apparatus 1 according to the present embodiment may improve flatness of the semiconductor wafer W after the polishing. In addition, when a material film (not illustrated) on the semiconductor wafer W is polished, the polishing apparatus 1 may inhibit irregularity in film thickness of the material film after the polishing.

The measurement unit 50, the calculation unit 60, and the control unit 70 may be disposed inside the polishing apparatus 1 or may be provided, as separate members, outside the polishing apparatus 1. When the measurement unit 50, the calculation unit 60, and the control unit 70 are separate members provided separately from the polishing apparatus 1, the measurement unit 50, the calculation unit 60, and the control unit 70 may be implemented by, for example, one or a plurality of personal computers.

Next, a polishing method according to the present embodiment will be described.

Figure 7:
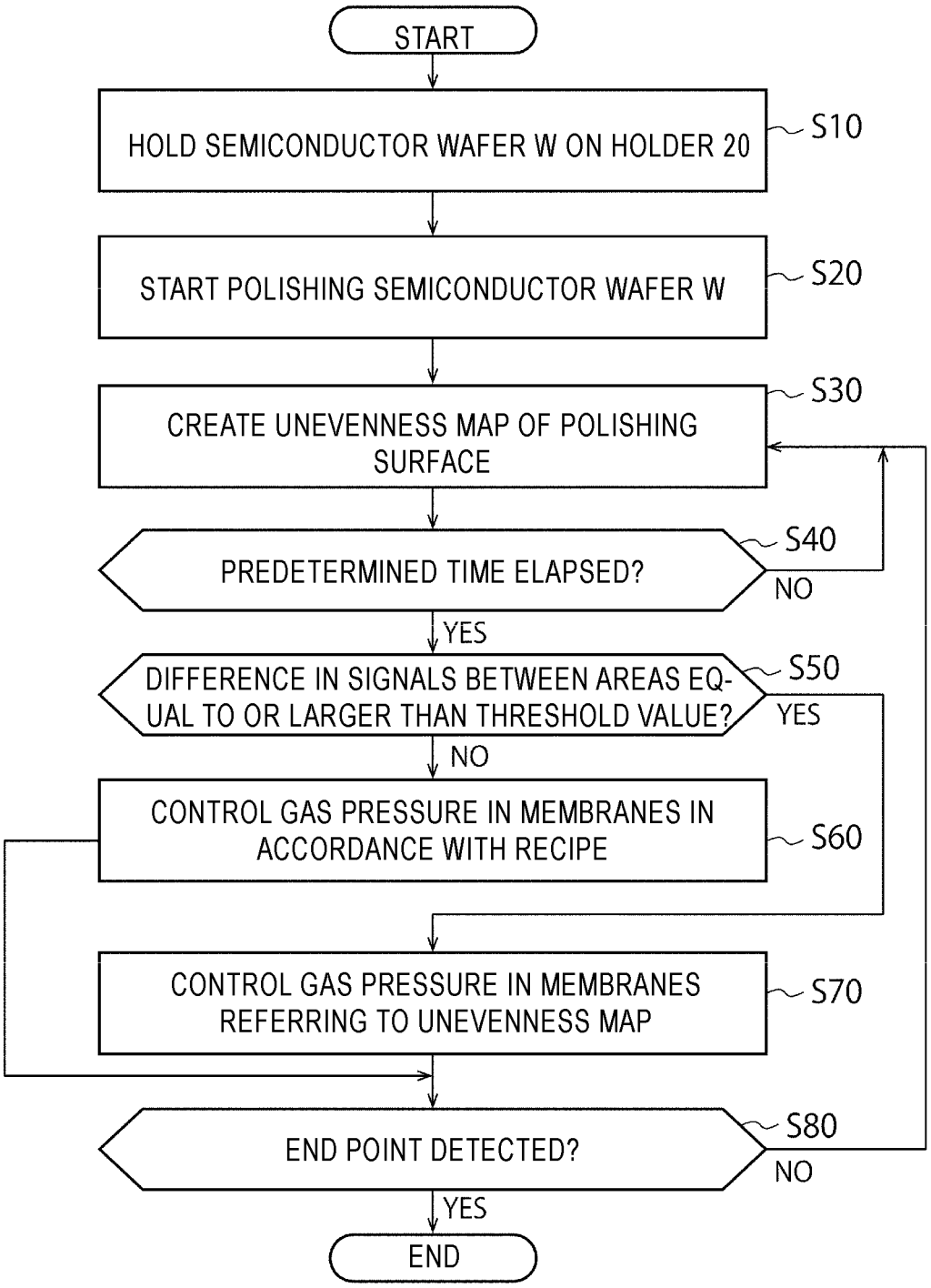
FIG. 7 is a flowchart illustrating an example of a polishing method according to the first embodiment.

FIG. 7 is a flowchart illustrating an example of the polishing method according to the first embodiment.

First, the semiconductor wafer W is held by the holder 20, and the semiconductor wafer W is pressed against the polishing pad 13 (S10).

Next, the polishing unit 10 and the holder 20 are rotated while slurry is supplied, so that the semiconductor wafer W begins to be polished (S20).

Figure 8:
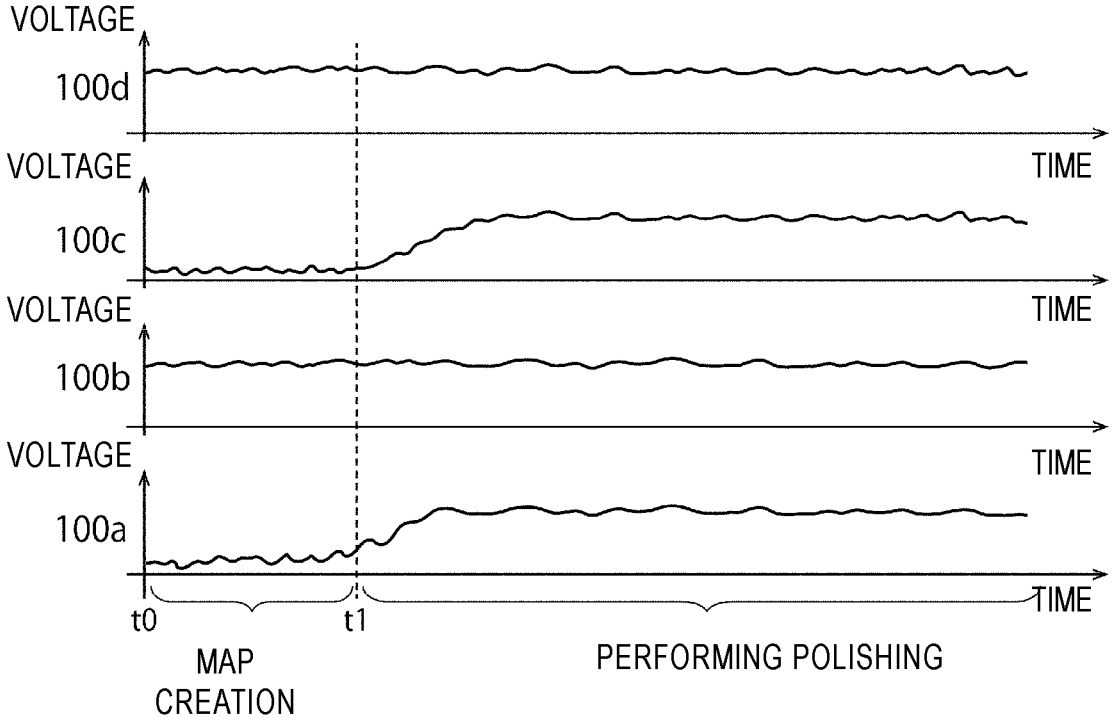
FIG. 8 is a graph illustrating magnitudes of signals from the vibration sensors.

Between the point in time at which the polishing starts and a predetermined point in time, the calculation unit 60 detects unevenness of the polishing surface of the semiconductor wafer W and creates the unevenness map for the polishing surface (S30). FIG. 8 is a graph illustrating magnitudes of the signals from the vibration sensors 100*a*, 100*b*, 100*c*, and 100*d*. The vertical axis indicates voltages of the signals, and the horizontal axis indicates time. A period of time of t0 to t1 is the period of time taken to create the unevenness map. A period of time after t1 is the period of time taken to perform the polishing. In addition, the polishing apparatus 1 may perform the polishing even for the period of time taken to create the unevenness map. In this case, the polishing apparatus 1 continues to perform the polishing after t1. The period of time (t0 to t1) taken to create the unevenness map may be arbitrarily set.

The period of time taken to create the unevenness map and the period of time take to perform the polishing may be periodically repeated during the process of polishing one sheet of the semiconductor wafer W. That is, the polishing and the creating of the unevenness map may be repeated, and the gas pressures in the membranes 23*a*, 23*b*, 23*c*, and 23*d* may be further controlled while the flatness (unevenness) of the semiconductor wafer W is detected in real time. Therefore, based on the unevenness map, the polishing apparatus 1 may control, in real time, the pressure that presses the semiconductor wafer W against the polishing unit 10.

During the period of time taken to create the map, the vibration sensors 100*a*, 100*b*, 100*c*, and 100*d* detect vibration of the semiconductor wafer W. The signals from the vibration sensors 100*a*, 100*b*, 100*c*, and 100*d*, which are converted by the measurement unit 50, are processed by the calculation unit 60. The calculation unit 60 averages the magnitudes of the signals from the vibration sensors 100*a*, 100*b*, 100*c*, and 100*d*. Further, the calculation unit 60 determines unevenness of the polishing surface of the semiconductor wafer W in the areas corresponding to the membranes 23*a*, 23*b*, 23*c*, and 23*d*, based on the averaged magnitudes of the signals in respect to the areas corresponding to the membranes 23*a*, 23*b*, 23*c*, and 23*d*. The determination of the unevenness is as described above. Further, the calculation unit 60 creates the unevenness map that represents flatness between the areas of the semiconductor wafer W which correspond to the membranes 23*a*, 23*b*, 23*c*, and 23*d*.

In the example illustrated in FIG. 8, for the period of time of t0 to t1 taken to create the map, an average value of the signals is comparatively small for the vibration sensors 100*c* and 100*a* and comparatively large for the vibration sensors 100*d* and 100*b*. Therefore, the unevenness map indicates that the polishing surface of the semiconductor wafer W is convex in the areas of the membranes 23*c* and 23*a*, and the polishing surface of the semiconductor wafer W is concave in the areas of the membranes 23*d* and 23*b*.

Referring again to FIG. 7, the calculation unit 60 continues to create the unevenness map until a predetermined time passes immediately after the polishing starts (NO in S40).

Meanwhile, the creating of the unevenness map ends when the predetermined time has passed immediately after the polishing started (YES in S40), at which time the calculation unit 60 compares a threshold value with a difference in signal between the areas of the membranes 23*a*, 23*b*, 23*c*, and 23*d* in the unevenness map (S50). The threshold value is the allowable value, set beforehand. When the difference in signals is small, this means there is almost no unevenness of the polishing surface of the semiconductor wafer W, and unevenness may be a detection error. Therefore, the allowable value is set in advance as the threshold value.

When a difference in signal between the areas is smaller than the threshold value (NO in S50), the control unit 70 controls the gas pressures in the membranes 23*a*, 23*b*, 23*c*, and 23*d* are depending on the predetermined recipe (S60).

However, when a difference in signal between the areas is equal to or larger than the threshold value (YES in S50), the control unit 70 controls the gas pressures in the membranes 23*a*, 23*b*, 23*c*, and 23*d* (S70). For example, when a difference in signal between the vibration sensor 100*a* (or 100*c*) in FIG. 8 and the vibration sensor 100*d* (or 100*b*) is larger than the threshold value, the control unit 70 makes the gas pressures in the membranes 23*a* and 23*c* higher than the gas pressures in the membranes 23*d* and 23*b*. The gas pressures in the membranes 23*a* and 23*c* may be increased in accordance with (for example, in proportion to) the magnitude of the difference between the difference in signal and the threshold value. Therefore, the polishing speed on the semiconductor wafer W is made greater in the areas of the membranes 23*a* and 23*c* than in the areas of the membranes 23*d* and 23*b*. Alternatively or additionally, the control unit 70 may make the gas pressures in the membranes 23*d* and 23*b* lower than the gas pressures in the membranes 23*a* and 23*c*. The gas pressures in the membranes 23*a* and 23*c* may be decreased in accordance with (for example, in proportion to) a magnitude of a difference between the difference in signal and the threshold value. Therefore, the speed at which the semiconductor wafer W is polished is made lower in the areas of the membranes 23*d* and 23*b* than in the areas of the membranes 23*a* and 23*c*. In addition, the control unit 70 may increase the gas pressure in the membrane to improve throughput by increasing the speed at which the semiconductor wafer W is polished.

A degree to which the gas pressures in the membranes 23*a*, 23*b*, 23*c*, and 23*d* are adjusted may be calculated by using a maximum value, a minimum value, and an average value of the signal in each of the areas for a predetermined period of time (e.g., a period of time of one loop from S30 to S70). For example, when increasing the gas pressure in the membrane 23*a*, the calculation unit 60 may set the rate of increase in gas pressure in the membrane 23*a* to be the value (1−Smin/Savg) obtained by subtracting from 1 the ratio (Smin/Savg) of the minimum value Smin to the average value Savg of the signal in the area corresponding to the membrane 23*a*. Specifically, when Smin/Savg is 0.9, the calculation unit 60 sets 0.1 (10%) to be the rate of increase. The control unit 70 increases the gas pressure in the membrane 23*a* by 10%. For example, when the current gas pressure in the membrane 23*a* is 300 Hpa, the control unit 70 controls and increases the gas pressure by 10% to 330 Hpa.

When decreasing the gas pressure in the membrane 23*a*, the calculation unit 60 may set the rate of decrease in gas pressure in the membrane 23*a* to be (Smax/Savg−1) obtained by subtracting 1 from the ratio (Smax/Savg) of the maximum value Smax to the average value Savg of the signal in the area corresponding to the membrane 23*a*. Specifically, when Smax/Savg is 1.2, the calculation unit 60 sets 0.2 (20%) as the rate of decrease. The control unit 70 decreases the gas pressure in the membrane 23*a* by 20%. For example, when the current gas pressure in the membrane 23*a* is 300 Hpa, the control unit 70 decreases the gas pressure to 240 Hpa.

Steps S30 to S70 are repeated until the end point is detected (NO in S80). Therefore, the creating of the unevenness map (t0 to t1) is periodically repeated during the polishing. The polishing ends when the polishing time reaches a predetermined time or when it is detected that the film thickness of the semiconductor wafer W is smaller than a predetermined film thickness.

When the endpoint is detected (YES in S80), the polishing process ends. Thereafter, an additional polishing process is performed as necessary, that is, when a residual film remains.

As described above, according to the present embodiment, the calculation unit 60 obtains the unevenness map for the polishing surface of the semiconductor wafer W based on the signals from the vibration sensor 100*a* and the like provided in the membranes 23*a* and the like. The vibration sensor 100*a* or the like is a contact sensor, so that the vibration sensor 100*a* may detect, with high precision, vibration from the polishing surface of the semiconductor wafer W which is caused by the polishing. Therefore, the unevenness map indicates flatness of the polishing surface of the semiconductor wafer W with high precision. Further, the control unit 70 feedback-controls the gas pressure in each of the membrane 23*a* and the like based on the unevenness map, and as a result, it is possible to correct the unevenness state (flatness) of the polishing surface of the semiconductor wafer W in real time during the polishing. As a result, the polishing apparatus 1 according to the present embodiment may improve flatness of the semiconductor wafer W or the material film after the polishing, thereby inhibiting irregularity in the thickness.

Second Embodiment

Figure 9:
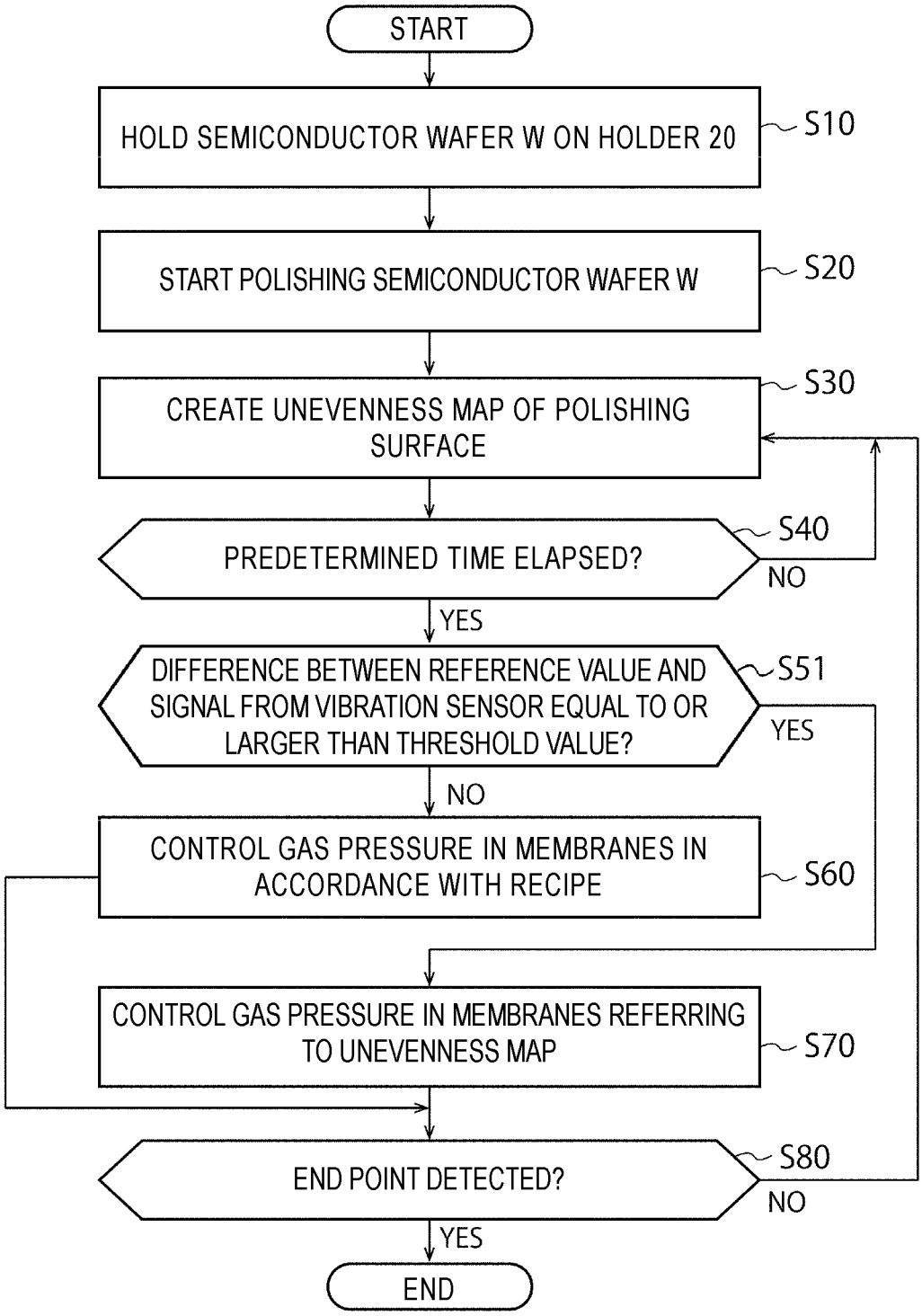
FIG. 9 is a flowchart illustrating an example of a polishing method according to a second embodiment.

FIG. 9 is a flowchart illustrating an example of a polishing method according to a second embodiment. In the first embodiment, in step S50, the calculation unit 60 compares the difference in signal between the areas of the membranes 23*a*, 23*b*, 23*c*, and 23*d* with the threshold value. The polishing apparatus 1 relatively compares the signals between the areas and controls the unevenness of the semiconductor wafer W such that the unevenness of the semiconductor wafer W is equal to or smaller than the threshold value.

In contrast, in the second embodiment, in step S51 as a substitute for step S50, the calculation unit 60 compares a difference between a reference value and a signal of each of the vibration sensors 100*a*, 100*b*, 100*c*, and 100*d* with a threshold value. The reference value is a value obtained by converting a target value of a thickness of the semiconductor wafer W at a certain point in time during the polishing into a signal (voltage) of each of the vibration sensors 100*a*, 100*b*, 100*c*, and 100*d*. That is, the reference value may represent a target of a thickness of the semiconductor wafer W at each point in time. In addition, the reference value may be applied in common to all of the vibration sensors 100*a*, 100*b*, 100*c*, and 100*d* in order to flatten the semiconductor wafer W. Alternatively, the reference values may be individually set for the vibration sensors 100*a*, 100*b*, 100*c*, and 100*d*, respectively, in consideration of differences between the membranes 23*a*, 23*b*, 23*c*, and 23*d* and individual difference between the vibration sensors 100*a*, 100*b*, 100*c*, and 100*d*.

Here, the target value of the thickness of the semiconductor wafer W will be described. For example, the thickness of the semiconductor wafer W is decreased as time passes after the polishing starts. Further, at the end of the polishing, the thickness of the semiconductor wafer W may become a finally desired film thickness. Therefore, when steps S30 to S70 are repeatedly performed, the target value of the thickness of the semiconductor wafer W at each processing point in time in step S51 is set such that the thickness is gradually decreased from a thickness (initial value) of the semiconductor wafer W when the polishing initially starts to a target value (final target value) of a final thickness of the semiconductor wafer W when the polishing ends. The polishing apparatus 1 may polish the semiconductor wafer W in accordance with the target value, thereby allowing the thickness of the semiconductor wafer W to asymptotically converge on the desired final target value.

Actually, to polish the semiconductor wafer W in accordance with the target value, the polishing apparatus 1 polishes the semiconductor wafer W by using the reference value that corresponds to the target value. That is, the polishing apparatus 1 polishes the semiconductor wafer W so that the signals from the vibration sensors 100*a*, 100*b*, 100*c*, and 100*d* are suitable for the reference value. Therefore, the polishing apparatus 1 may allow the thickness of the semiconductor wafer W to converge on the desired final target value. In addition, at a certain processing point in time in step S51, the reference value of the signals of the vibration sensors 100*a*, 100*b*, 100*c*, and 100*d* is a value obtained by converting the target value of the thickness of the semiconductor wafer W at that point in time into the signals (voltages) of the vibration sensors 100*a*, 100*b*, 100*c*, and 100*d*. The reference value is set in advance and stored in a memory (not illustrated) in the calculation unit 60.

In step S51, referring to the unevenness map, the calculation unit 60 compares the difference between the reference value and the signal from each of the vibration sensors 100*a*, 100*b*, 100*c*, and 100*d* with the threshold value (S51).

When the difference between the reference value and the signal from any one of the vibration sensors 100*a*, 100*b*, 100*c*, and 100*d* is smaller than the threshold value (NO in S51), the control unit 70 determines that the signal from the vibration sensor is close to the reference value, and the control unit 70 controls the gas pressures in the membranes 23*a*, 23*b*, 23*c*, and 23*d* in accordance with the recipe (S60). The reason is that the thickness of the semiconductor wafer W in the area corresponding to the membrane is considered as almost reaching the target value.

However, when the difference (reference value difference) between the reference value and the signal from any one of the vibration sensors 100*a*, 100*b*, 100*c*, and 100*d* is equal to or larger than the threshold value (YES in S51), the control unit 70 controls the gas pressures in the membranes 23*a*, 23*b*, 23*c*, and 23*d* (S70). For example, when the signal from the vibration sensor 100*a* is larger than the reference value by the threshold value or more, the thickness of the semiconductor wafer Win the area corresponding to the membrane 23*a* is smaller than the target value. Therefore, the control unit 70 makes the gas pressure in the membrane lower than the recipe. Meanwhile, in a case where the signal from the vibration sensor 100*a* is smaller than the reference value by the threshold value or more, the thickness of the semiconductor wafer W in the area corresponding to the membrane 23*a* is larger than the target value. Therefore, the control unit 70 makes the gas pressure in the membrane 23*a* higher than the recipe. The control unit 70 also similarly controls the gas pressures in the other membranes 23*b*, 23*c*, and 23*d*. In addition, the gas pressure in the membrane may be increased or decreased in accordance with (e.g., in proportion to) a magnitude of the difference between the reference value difference and the threshold value.

Steps S30 to S70 are repeated until the end point is detected (NO in S80). When the end point is detected (YES in S80), the polishing process ends. In the second embodiment, the polishing is performed such that the thickness of the semiconductor wafer W converges on the final target value. Therefore, hardly any residual film remains, and an additional polishing process is not required. This leads to an improvement of productivity.

In this way, the difference between the reference value and the signal from the vibration sensor 100*a* or the like may be compared with the threshold value. The other operations of the second embodiment may be similar to the corresponding operations of the first embodiment. Therefore, the second embodiment may also obtain the same effect as the first embodiment.

Third Embodiment

Figure 10:
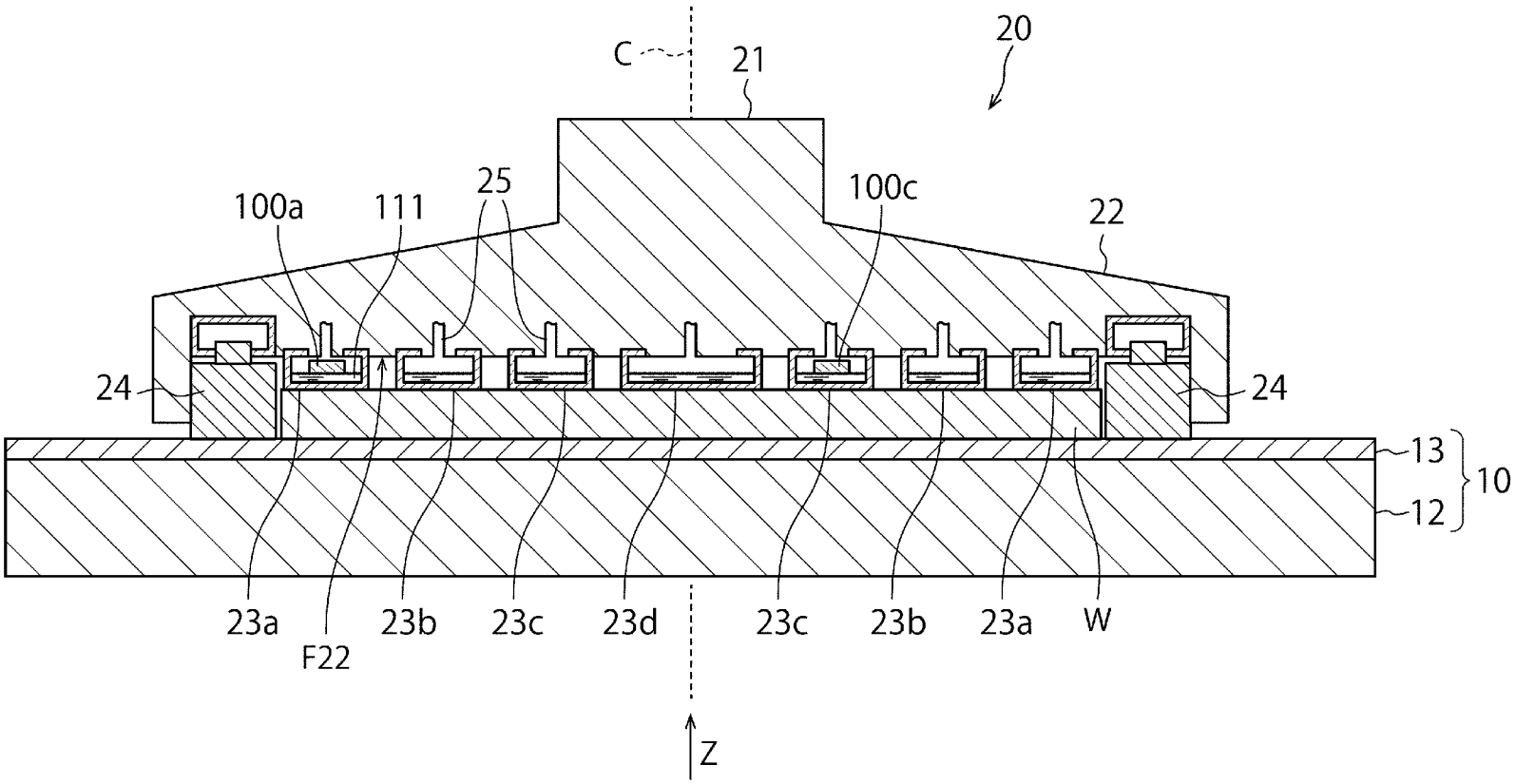
FIG. 10 is a schematic view illustrating a configuration example of a polishing apparatus according to a third embodiment.

FIG. 10 is a schematic view illustrating a configuration example of a polishing apparatus according to a third embodiment. In the first embodiment, the membrane 23*a* or the like has therein the cavity H, and the vibration sensor 100*a* or the like is provided in the cavity H.

In contrast, in the third embodiment, a liquid 111 is introduced into the membrane 23*a* or the like. The liquid 111 may be a water-soluble liquid such as water, an oil-based liquid such as oil, or a liquid having viscosity.

In this case, the vibration sensor 100*a* or the like may float on the liquid 111. For example, in addition to the AE sensor, a hydrophone sensor, an ultrasonic sensor, or the like is used as the vibration sensor 100*a* or the like. The vibration sensor 100*a* or the like may detect vibration from the semiconductor wafer W through the liquid 111 and the membrane 23*a* or the like.

The other configurations of the third embodiment may be similar to the corresponding configurations of the first embodiment. Therefore, the third embodiment may also obtain the same effect as the first embodiment. In addition, the third embodiment may be combined with the second embodiment. Therefore, the third embodiment may also obtain the same effect as the second embodiment.

While certain embodiments have been described, these embodiments have been presented byway of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit, of the inventions. The accompanying claims and their equivalents are intended to cover such forms or modifications as would fall within the scope and spirit of the inventions.

What is claimed is:

1. A polishing apparatus comprising:

a polisher configured to polish a target object to be polished;

a holder configured to rotate while holding the target object to be polished;

a plurality of elastic members provided on the holder concentrically around a center of a rotation shaft of the holder and configured to elastically press the target object to be polished against the polisher;

a plurality of vibration sensors provided in the plurality of elastic members and configured to detect vibration from a polishing surface of the target object to be polished;

a calculator configured to determine unevenness of the polishing surface of the target object to be polished based on the vibration detected by the plurality of vibration sensors; and a controller configured to control pressures of the plurality of elastic members against the target object to be polished based on the unevenness of the polishing surface of the target object to be polished.

2. The polishing apparatus according to claim 1, wherein at least one of the plurality of elastic members has a hollow cavity and is configured to press the target object to be polished against the polisher by supplying gas to the cavity, and at least one of the plurality of vibration sensors is provided in the cavity.

3. The polishing apparatus according to claim 2, wherein when the target object is polished when the vibration sensors come into contact with the target object to be polished through the elastic members.

4. The polishing apparatus according to claim 3, wherein the target object to be polished is polished when the vibration sensors in the elastic members rotate relative to the target object to be polished.

5. The polishing apparatus according to claim 1, wherein the calculator is configured to determine a pressure inside each of the plurality of elastic members according to signals detected from respective ones of the plurality of vibration sensors.

6. The polishing apparatus according to claim 1, wherein the calculator is configured to determine a pressure of each of the plurality of elastic members, respectively, based on a difference between a predetermined reference value and a signal detected from a respective one of the plurality of vibration sensors.

7. A polishing method using a polishing apparatus that includes a polisher configured to polish a surface of a target object to be polished; a holder configured to be rotatable while holding the target object to be polished; a plurality of elastic members provided on the holder concentrically around a center of a rotation shaft of the holder; and a plurality of vibration sensors provided in the plurality of elastic members, the polishing method comprising:

rotating the target object to be polished while elastically pressing the target object to be polished against the polisher;

detecting, using the plurality of vibration sensors, a vibration from the surface of the target object to be polished;

determining, using a calculator, an unevenness of the polishing surface of the target object to be polished based on the vibration detected by the plurality of vibration sensors; and controlling, using a controller, pressure inside one or more of the plurality of elastic members based on the unevenness of the polishing surface of the target object to be polished.

8. The polishing method of claim 7, wherein controlling the pressure comprises controlling the pressure based on a control sequence which is set in advance based on the detected vibration.

9. The polishing method of claim 8, wherein controlling the pressure further comprises determining that a difference in vibration signals detected between areas is not equal to or greater than a threshold value.

10. The polishing method of claim 8, wherein controlling the pressure further comprises determining that a difference between a vibration signal and a reference value is not equal to or greater than a threshold value.

11. The polishing method of claim 7, wherein determining the unevenness of the polishing surface comprises creating an unevenness map of the polishing surface based on the detected vibration, and wherein controlling the pressure comprises controlling the pressure according to the unevenness map.

12. The polishing method of claim 11, wherein controlling the pressure further comprises determining that a difference in vibration signals detected between areas is equal to or greater than a threshold value.

13. The polishing method of claim 11, wherein controlling the pressure further comprises determining that a difference between a vibration signal and a reference value is equal to or greater than a threshold value.

14. A polishing system for polishing a target surface, the polishing system comprising:

a polisher comprising:

one or more pressure actuated members movable to contact with the target surface; and one or more vibration sensors, at least one of the one or more vibration sensors disposed in one of the one or more pressure actuated members;

a computer connected to the one or more vibration sensors;

a calculator connected to the computer and configured to determine a vibration signal obtained by the computer; and a controller configured to receive the vibration signal from the calculator and to control a driver to actuate the polisher such that the one or more pressure actuated members move against the target surface, and the at least one of the one or more vibration sensors are movable relative to the one of the one or more pressure actuated members; and a first magnetic rail and a second magnetic rail structured to keep the at least one vibration sensor in place with respect to the target surface during polishing.

15. The polishing system of claim 14, wherein the polisher further comprises an electromagnet configured to push the at least one vibration sensor against the one or more pressure actuated members to engage the target surface so as to permit measurement of unevenness.

16. The polishing system of claim 15, wherein the calculator is further configured to create a map of the unevenness.

17. The polishing system of claim 16, wherein the controller, in response to a determination that a difference in vibration signals between areas is equal to or greater than a threshold value or that a difference between a vibration signal and a reference value is equal to or greater than a threshold value, is configured to control a respective pressure in one of the one or more pressure actuated members to apply a polishing pressure on the target surface based on the map of the unevenness.

18. The polishing system of claim 16, wherein the controller, in response to a determination that a difference in vibration signals between areas is not equal to or greater than a threshold value or that a difference between a vibration signal and a reference value is not equal to or greater than a threshold value, is configured to control a respective pressure in one of the one or more pressure actuated members to apply a polishing pressure on the target surface based on a control sequence set in advance.

* * * * *